United States Patent [19]

Martin

[11] Patent Number: 4,534,077

[45] Date of Patent: Aug. 13, 1985

[54] HOSPITAL BED HAVING SAFETY MECHANISM

[75] Inventor: Kelly D. Martin, Lawndale, N.C.

[73] Assignee: Simmons Universal Corporation, New York, N.Y.

[21] Appl. No.: 538,722

[22] Filed: Oct. 3, 1983

[51] Int. Cl.[3] ..... A61G 7/06; A61G 7/00

[52] U.S. Cl. ..... 5/424; 5/60; 5/63; 5/66; 5/508

[58] Field of Search ..... 5/60, 63, 66, 424, 508; 297/330

[56] References Cited

U.S. PATENT DOCUMENTS

| | | | |
|---|---|---|---|
| 3,533,095 | 10/1970 | Collins | 340/373 |
| 3,874,728 | 4/1975 | Weiland | 297/330 |
| 4,025,972 | 5/1977 | Adams et al. | 5/63 |
| 4,067,005 | 1/1978 | Levy et al. | 5/424 |
| 4,403,214 | 9/1983 | Wolar | 5/424 |
| 4,407,030 | 10/1983 | Elliott | 5/66 |
| 4,463,463 | 8/1984 | Kaneko | 5/424 |

FOREIGN PATENT DOCUMENTS

| | | | |
|---|---|---|---|
| 2144205 | 6/1978 | Fed. Rep. of Germany | 297/330 |

*Primary Examiner*—Gary L. Smith
*Assistant Examiner*—Michael F. Trettel
*Attorney, Agent, or Firm*—A. Thomas Kammer

[57] ABSTRACT

A hospital bed is provided with a safety mechanism for preventing the upper frame from moving with respect to the lower frame when an object or person is wedged therebetween. The safety mechanism includes an elongate detection device such as an air-tight, flexible tube or a ribbon switch. It is mounted to one of the frames so that a person wedged between the frames will contact it prior to incurring serious injury. The detection device is connected to a switch which deactuates the bed raising/lowering motor.

9 Claims, 5 Drawing Figures

HOSPITAL BED HAVING SAFETY MECHANISM

BACKGROUND OF THE INVENTION

1. Field of the Invention

The field of the invention relates to a hospital bed including a mechanism for adjusting the height thereof and a safety system for controlling the operation of said mechanism.

2. Brief Description of the Prior Art

Hospital beds are designed to quickly and smoothly assume a full range of medical positions. Electric motors have been employed to operate head, knee and height functions. One such bed utilizes three direct drive 0.1 horsepower motors, one for each of these three functions. Pneumatic patient controls mounted on a safety rail allow the bed to be adjusted to nearly any desired position. Lock out switches may be provided out of the patient's reach at the foot end of the bed when restricted positioning is required.

A hosptial bed is raised or lowered by causing the mattress-supporting frame to move with respect to a stationary frame positioned below. Since it may take about thirty seconds to move between the highest and lowest positions, many beds have been equipped with "constant-on" switches to allow the nurse to simply press a button to effect full raising or lowering. This allows the nurse to perform other duties as the bed is moving toward the desired position.

A significant disadvantage of the "constant-on" feature is that it may result in injury if accidentally actuated while a person is under the bed. This may occur in children's wards where they may climb out of a bed and so position themselves. It can also be a problem where a patient has a psychological disorder. Since a pair of bed frames are moving constantly closer to one another when the bed is lowered, any part of the body trapped therebetween can be subject to serious injury.

One solution has been to avoid the use of a constant-on switch. While effective, it does require the nurse to keep her finger on the button for a period of time and restricts her from proceding with other tasks.

SUMMARY OF THE INVENTION

A hospital bed is provided having a safety system for preventing a bed from being lowered when a person or object is between the moving and stationary frames thereof. The safety feature may include an elongate, air-tight tube (or tubes) mounted on one of the frames such that a person will contact it before serious injury occurs. A pneumatic switch connected to the tube will de-actuate the lowering mechanism upon the exertion of pressure on the tube.

Alternatively, a ribbon switch may be secured about one of the frames to prevent injury. A force exerted at any point thereof would open a control switch thereby stopping the bed height adjustment motor. Whether an extruded tube or a ribbon switch is employed, it should cover the area within which a person is most likely to be trapped by the two approaching frames.

DETAILED DESCRIPTION OF THE INVENTION

Figure 1:
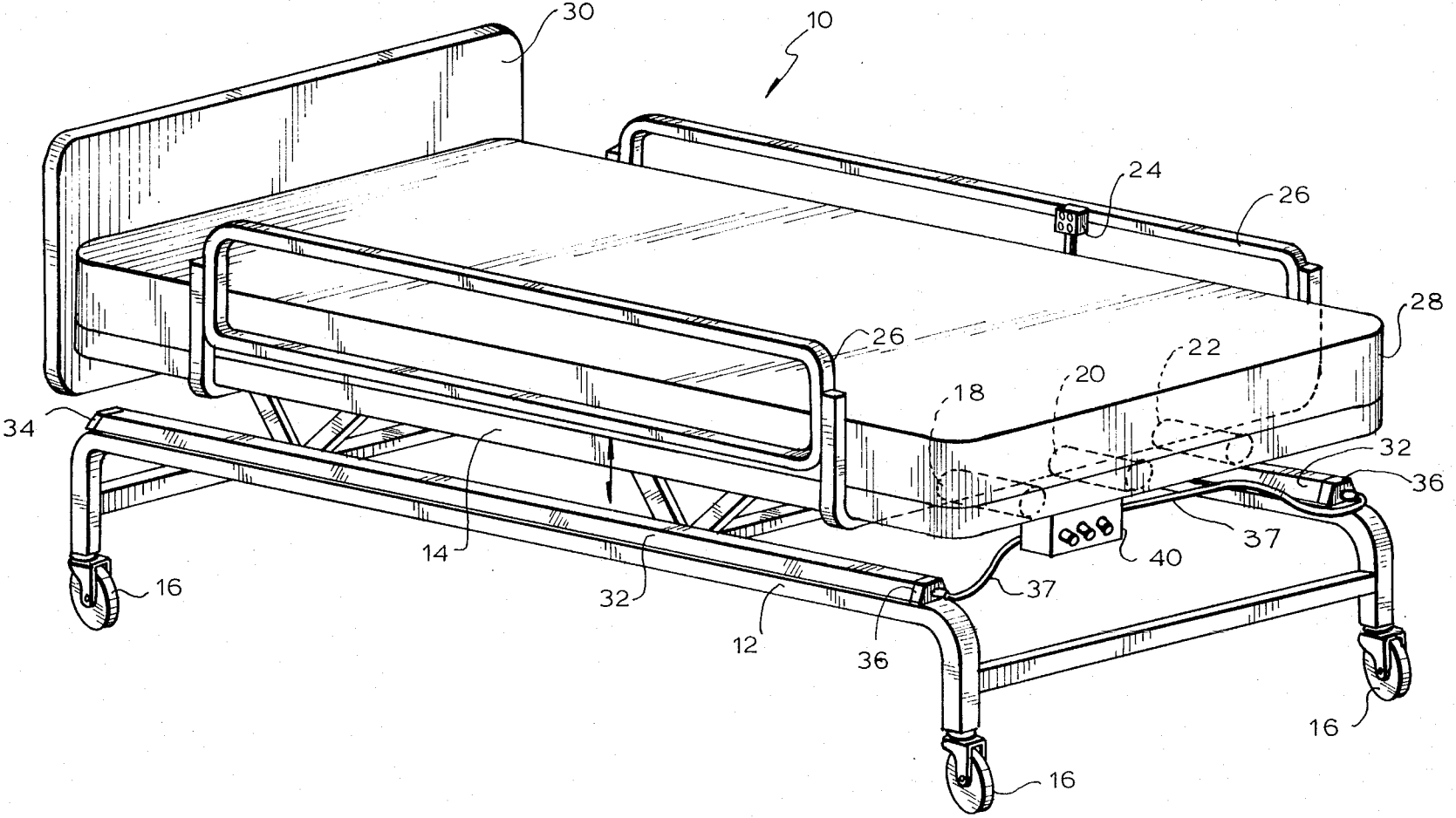
FIG. 1 is a perspective view of a hospital bed according to the invention.

A hospital bed 10 including a stationary lower frame 12 and a movable upper frame 14 is shown in the drawings. A set of wheels 16 is mounted to the lower frame 12. Three direct drive motors 18, 20, 22 are mounted to one of the frames. They are used to operate the head, knee and height functions thereof in a conventional manner. A control 24 mounted to one of the side rails 26 allows the patient or nurse to control these functions.

A matress 28 is supported by the upper frame 14 and will articulate therewith. A removable head board 30 is mounted to one end of the bed. Similarly, a removable foot board (not shown) may be mounted to the opposite end.

Motor 20 is responsible for the raising and lowering of frame 14 with respect to frame 12. The control 24 includes buttons for actuating each of the three motors. When the "up" button is pressed to raise the bed, frame 14 moves steadily towards its maximum height. Upon reaching that height, the motor 20 is deactuated. It will operate in a similar manner when a "down" button is pushed.

In order to prevent injury to a person who may be under the bed while frame 14 is moving towards frame 12, an effective safety system may be employed. A pair of elongate, air-tight extrusions 32 or tubes is mounted to the lower frame 12. They extend substantially the entire length of both of the sides of this frame. If necessary or desirable, additional extrusions may be provided in the lateral directions if the frames 12, 14 could cause potential injury there. They could be mounted to either the movable or stationary frames as the manufacturer sees fit.

Plugs 34 seal the front ends of the extrusions 32 while plug connectors 36 are secured to the opposite ends. An air line 37 is connected between each of the plug connectors and one of two limit switches 38 within a control box 40. The limit switches are opened when pressure is exerted on the extrusions.

Figure 3:
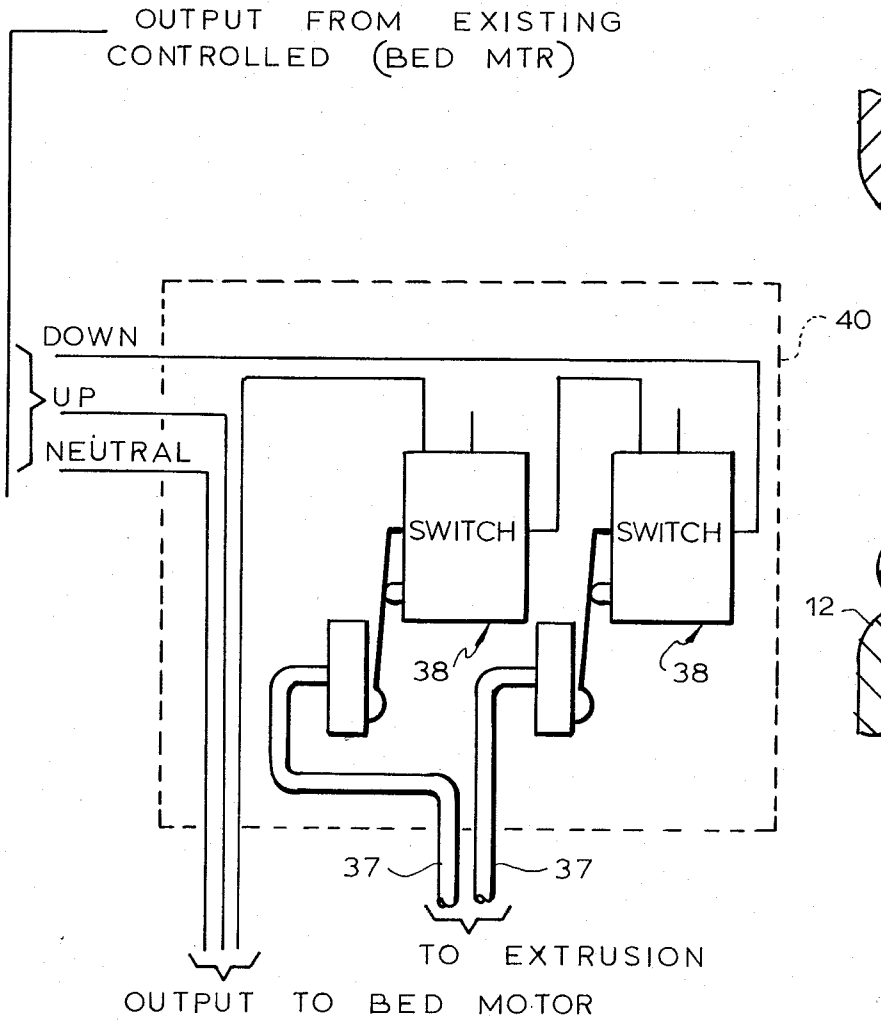
FIG. 3 is a schematic illustration of a control system for the hospital bed.
Figure 2:
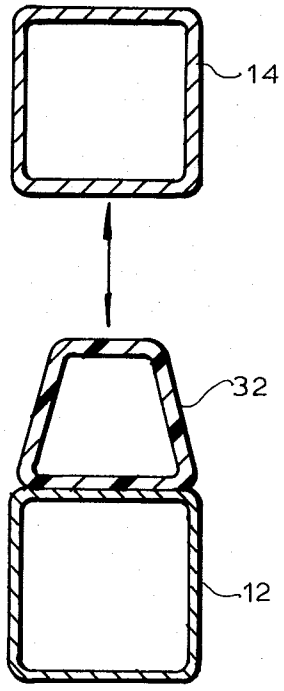
FIG. 2 is a sectional view thereof illustrating a pair of frame members and an air-tight extrusion mounted to one of said frame members.

Referring to FIG. 3, a pair of normally closed switches is shown as being connected in series with each other as well as the down button of control 24 and motor 20. If either switch is opened, the motor 20 will accordingly be deactuated. The system is arranged such that the down button must be pressed again for the switch to be closed and for downward movement to resume.

Figure 4:
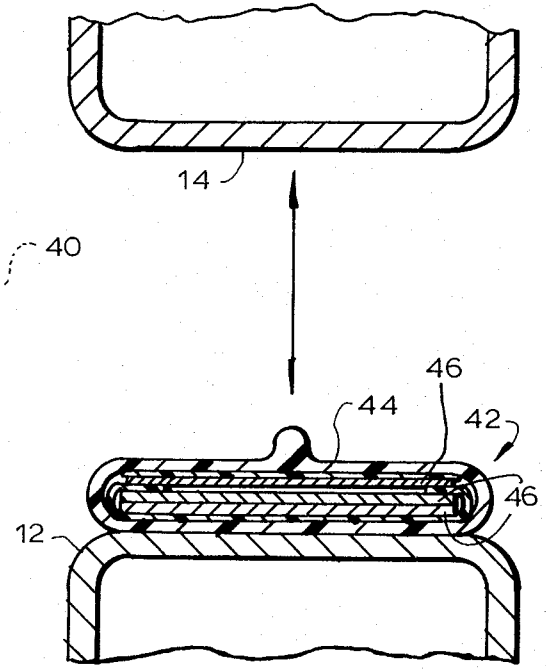
FIG. 4 is a sectional view illustrating an alternative embodiment of the invention.

Solid state controls may be employed if a strip switch 42 is used instead of an extrusion. FIG. 4 illustrates a strip switch detector mounted to the lower frame 12 of the bed. It includes a polymeric jacket 44 and a plurality of contacts 46 therein. Such switches have been used in conjunction with alarm systems.

Figure 5:
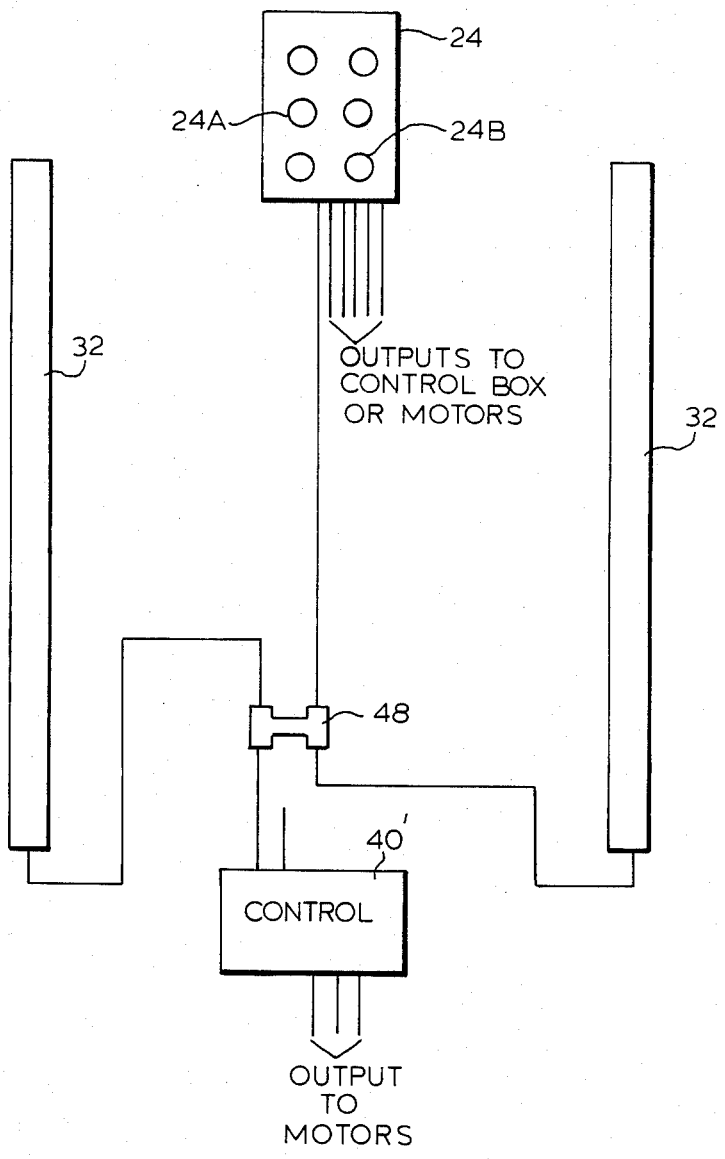
FIG. 5 is a schematic illustration of an alternative embodiment of the invention.

An alternative embodiment of the invention is illustrated schematically in FIG. 5. Some of the same numerals employed in FIGS. 1–4 are used to designate substantially identical structures. In this arrangement, the up button 24A and the down button 24B on the control 24 are each connected to the control box 40'. When the patient depresses the down button and releases it, the bed descends continuously until it reaches its lowest position. Motor 20 is thereafter deactuated. The downward movement of the bed can be terminated immediately upon: (1) pressing the up button 24A, or (2) contacting either extrusion 32. Either of these events will pull a switch blade in the control box 40' away from the bed down switch, thereby causing the motor 20 to raise the bed. Both the up button 24A and the extrusions 32 are connected to the control box 40' by way of connector 48. The same signal is accordingly received by the control box 40' whether the up button 24A is pressed or either extrusion 32 compressed. A person trapped between the frames 12, 14 will accordingly be released before serious injury can occur.

The safety system according to the invention allows the use of "constant-on" features without the dangers formerly associated therewith. It will be appreciated that other detectors may be used in addition to or in lieu of those specifically discussed herein for detecting the presence of an unwanted object between the frames. Photosensitive devices and the like may be used for these purposes. The positioning of the detectors is also within the manufacturer's discretion.

What is claimed is:

1. In a hospital bed including a stationary frame, a movable frame for supporting a mattress and patient, and a motor for effecting vertical movement of said movable frame with respect to said stationary frame, the improvement comprising an elongate detection device mounted to one of said frames for detecting the presence of a person or object between said frames, said elongate detection device being an air-tight flexible tube which is compressible against said one of said frames, and means responsive to said detection device for preventing said motor from moving said movable frame closer to said stationary frame.

2. The improvement as defined in claim 1 wherein said detection device is mounted to the upper surface of said stationary frame.

3. The improvement as defined in claim 1 including a plurality of elongate detection devices mounted to one of said frames, said means for preventing said motor from moving said movable frame being responsive to all of said detection devices.

4. The improvement as defined in claim 3 wherein said detection devices are mounted to substantially all surfaces of one of said frames where a person could become wedged between said frames.

5. The improvement as defined in claim 3 wherein each of said detection devices is connected, respectively, to respective normally closed switches, said normally closed switches being connected in series between a bed controller and said bed motor.

6. The improvement as defined in claim 5 wherein said bed controller includes up and down control buttons, said switches being connected in series between said down control button and said bed motor, said up control button being connected directly to said motor.

7. The improvement as defined in claim 1 wherein said means responsive to said detection device cause said movable frame to move away from said stationary frame upon one's contacting said detection device.

8. The improvement as defined in claim 1 wherein said tube includes first and second ends, said first end being closed and said second end having an air line extending therefrom, and a limit switch connected to said air line.

9. The improvement as defined in claim 1 wherein said tube has a trapezoidal cross section defined in part by a relatively large surface and a relatively small surface parallel thereto, said relatively large surface bearing against said one of said frames.

* * * * *